US011435699B2

(12) United States Patent
Braun

(10) Patent No.: US 11,435,699 B2
(45) Date of Patent: Sep. 6, 2022

(54) TOURBILLION WITH A ZERO RESET MECHANISM

(71) Applicant: Glashuetter Uhrenbetrieb GmbH, Glashuette/Sachsen (DE)

(72) Inventor: Tony Braun, Mueglitztal (DE)

(73) Assignee: Glashuetter Uhrenbetrieb GmbH, Glashuette/Sachsen (DE)

( * ) Notice: Subject to any disclaimer, the term of this patent is extended or adjusted under 35 U.S.C. 154(b) by 597 days.

(21) Appl. No.: 16/433,112

(22) Filed: Jun. 6, 2019

(65) Prior Publication Data

US 2020/0004206 A1 Jan. 2, 2020

(30) Foreign Application Priority Data

Jun. 29, 2018 (EP) ..... 18180966

(51) Int. Cl.
*G04B 17/28* (2006.01)
*G04F 7/06* (2006.01)
*G04F 7/08* (2006.01)

(52) U.S. Cl.
CPC ..... *G04B 17/285* (2013.01); *G04F 7/062* (2013.01); *G04F 7/0814* (2013.01)

(58) Field of Classification Search
CPC ..... G04B 17/28; G04B 17/285; G04B 15/14; G04F 7/062; G04F 7/0804; G04F 7/0814
See application file for complete search history.

(56) References Cited

U.S. PATENT DOCUMENTS 9,897,972 B2 * 2/2018 Heise ..... G04B 27/001
2014/0313865 A1 * 10/2014 Heise ..... G04B 15/14 368/130
2015/0063083 A1 3/2015 Kawauchiya et al.
2016/0266547 A1 * 9/2016 Kawauchiya ..... G04B 15/14
(Continued)

FOREIGN PATENT DOCUMENTS

CH 704 783 A1 10/2012
CH 711 476 A2 3/2017
CN 1722026 A 1/2008
(Continued)

OTHER PUBLICATIONS

Japanese Office Action dated Jul. 21, 2020 in Japanese Patent Application No. 2019-113423 (with English translation), 17 pages.
(Continued)

*Primary Examiner* — Daniel P Wicklund
(74) *Attorney, Agent, or Firm* — Oblon, McClelland, Maier & Neustadt, L.L.P.

(57) ABSTRACT

A movement includes a tourbillion block, a tourbillion unit, and a zero reset mechanism. The tourbillion unit includes a carriage, a balance wheel, and an escape wheel. The balance wheel and the escape wheel are rotationally arranged on the carriage. The carriage is rotationally supported on the tourbillion block. The zero reset mechanism includes a first wheel in engagement with the escape wheel. The movement is switchable between a driving mode and a reset mode. When in the driving mode, the zero reset mechanism is rotationally locked to the tourbillion block. When in the reset mode, the zero reset mechanism is rotatable relative to the tourbillion block.

14 Claims, 7 Drawing Sheets

(56) References Cited

U.S. PATENT DOCUMENTS

| | | | |
|---|---|---|---|
| 2017/0060090 | A1 | 3/2017 | Heise |
| 2017/0060091 | A1 | 3/2017 | Heise |

FOREIGN PATENT DOCUMENTS

| | | | |
|---|---|---|---|
| CN | 101846962 | A | 9/2010 |
| CN | 104111600 | A | 10/2014 |
| CN | 106483817 | A | 3/2017 |
| CN | 106483818 | A | 3/2017 |
| CN | 106970513 | A | 7/2017 |
| EP | 3 136 186 | A1 | 3/2017 |
| EP | 3 136 187 | A1 | 3/2017 |
| FR | 3 023 933 | A1 | 1/2016 |
| JP | 2017-49235 | A | 3/2017 |
| JP | 2017-49236 | A | 3/2017 |

OTHER PUBLICATIONS

Korean Office Action dated Oct. 7, 2020 in Korean Patent Application No. 10-2019-0075714 (with English translation), 10 pages.
Combined Chinese Office Action and Search Report dated Dec. 10, 2020 in Chinese Patent Application No. 201910566996.5 (with English translation of Office Action only), 13 pages.
European Search Report dated Dec. 13, 2018 in European Application 18180966.6 filed on Jun. 29, 2018.

* cited by examiner

TOURBILLION WITH A ZERO RESET MECHANISM

CROSS-REFERENCE TO RELATED APPLICATIONS

The present application claims priority to European Patent Application No. 18180966.6, filed on Jun. 29, 2018, the entire content and disclosure of which are incorporated by reference herein.

FIELD OF THE INVENTION

The present invention and disclosure relates to a movement comprising a tourbillion unit. In particular it relates to a movement of a watch, e.g. of a wristwatch comprising a tourbillion unit and further comprising a zero reset mechanism.

BACKGROUND

A movement including a tourbillion is for instance described in EP 2793087 B1. The tourbillion comprises a rotatably mounted rotating carriage, a balance mounted on the rotating carriage and an escape wheel mounted on the rotating carriage and operatively connected to the balance via a lever. There is further disclosed a brake element arranged on the rotating carriage that can be brought into engagement with the balance by way of an axial movement. Such a brake element is particularly applicable to a tourbillion configured as a flying tourbillion.

Another movement with a tourbillion unit is known from CH 711 476 A2. Nevertheless, during the reset mode, two arms pushes against a stop ring to stop the balance wheel and to start the rotation. This contact force causes a massive power loss that is not usable for a mechanical watch.

It is a particular aim of the present invention and disclosure to provide a movement with a tourbillion unit, wherein the tourbillion unit can be operationally decoupled from a mechanical energy reservoir and wherein the tourbillion unit, at least the rotating carriage thereof can be freely rotated relative to a base of the movement in order to return the rotating carriage into a predefined rotational state, e.g. into a zero reset configuration. It is a further aim to implement a movement with a tourbillion unit and a zero reset mechanism providing a zero reset function of the tourbillion unit configured to consume only a minimum of mechanical energy.

SUMMARY

In one aspect there is provided a movement comprising a tourbillion block, a tourbillion unit and a zero reset mechanism. The tourbillion unit comprises a carriage, a balance wheel and an escape wheel. The balance wheel and the escape wheel are rotationally arranged on the carriage. The carriage is further rotationally supported on the tourbillion block. Typically, the tourbillion block is mounted on a base of the movement. The tourbillion block is immobile relative to the base. It remains fastened on the base. The zero reset mechanism comprises a first wheel in engagement with the escape wheel. The balance wheel is typically subject to an oscillating rotational movement and the escape wheel is typically subject to a stepwise continuous rotation as the movement is in a driving mode. Typically and in the driving mode the first wheel of the zero reset mechanism is fastened relative to the tourbillion block and relative to the base of the movement. Since the teeth of the escape wheel mate with corresponding teeth of the first wheel the axis of the escape wheel moves around the first wheel thus leading to a rotating motion of the entire carriage and the tourbillion unit.

The movement is switchable between a driving mode and a reset mode. When in the driving mode the zero reset mechanism is rotationally locked to the tourbillion block. When in the reset mode the zero reset mechanism is freely rotatable relative to the tourbillion block. In the reset mode at least the first wheel is rotatable relative to the tourbillion block and hence relative to the base of the movement. While in the reset mode the escape wheel remains engaged with the first wheel of the zero reset mechanism. When switched in the reset mode the entire zero reset mechanism may be rotatable relative to the tourbillion block.

Typically, and when in the reset mode, the entire zero reset mechanism is void of a mechanical contact to radially inwardly extending guiding structures of the tourbillion block or of movement, respectively. In particular, the outer circumference, e.g. a radially outwardly located portion or section of the zero reset mechanism, is out of mechanical contact to any arbitrary component of the movement or of the tourbillion block. In this way, mechanical and dynamic friction for rotating at least one of the zero reset mechanism and the tourbillion unit can be reduced to a minimum, thus allowing to increase a power reserve of the movement.

Alternative, at least the first wheel of the zero reset mechanism is rotatable relative to the tourbillion block whereas other components of the zero reset mechanism remain fastened and immobile relative to the tourbillion block.

The zero reset mechanism is selectively rotationally engageable with only one of the tourbillion unit and the tourbillion block at a time. When in the driving mode the zero reset mechanism is rotationally locked to the tourbillion block while the tourbillion unit is rotatable relative to the zero reset mechanism. When in the reset mode the zero reset mechanism becomes rotatable relative to the tourbillion block while it is rotationally locked to the tourbillion unit. In this way, the entire tourbillion unit becomes rotatable in unison with the zero reset mechanism.

By selectively rotationally releasing the zero reset mechanism in the reset mode a precise synchronization of the movement can be conducted. When in the reset mode, the tourbillion unit as well as the zero reset mechanism may be totally void of external mechanical influences. Friction losses for rotating of the tourbillion unit into a predefined reset position can be reduced to a minimum. As a consequence, mechanical energy dissipation for rotating the tourbillion unit into the predefined reset position or reset orientation can be reduced.

According to a further example the movement comprises a brake element arranged on the carriage and being one of axially displaceable and axially deformable from a release position or release state into a braking position or braking state. When in the braking state the brake element axially engages with the balance wheel. In particular, the brake element may axially engage with an outer rim of the balance wheel. Engagement of the brake element with the balance wheel is obtained either by axially displacing the brake element as such or by means of applying an axially directed force onto a portion of the brake element such that the brake element is subject to an axial deformation thus bringing a portion of the brake element into axial abutment or axial engagement with the balance wheel.

A mutual abutment or axial engagement of the brake element with an outer rim of the balance wheel provides a precise and highly reliable braking or stopping of the balance wheel. For instance, the brake element may be configured to apply an axially directed friction force onto the outer rim of the balance wheel. The axial engagement of the brake element with the outer rim may be beneficial compared to an axial engagement with a radial central portion of the balance wheel because the resulting braking torque acting on the balance wheel increases with a radial distance from a center of the balance wheel. Applying a first braking force of a first magnitude to a radial center of the balance wheel will produce a first braking torque. Applying the same force to the outer rim of the balance wheel and hence at an increased radial distance from the central portion of the balance wheel will result in a second braking torque being larger than the first braking torque.

In effect and applying only a rather moderate or comparatively small axial braking force on the outer rim of the balance wheel may be sufficient to stop the balance wheel and hence to stop the driving motion of the movement.

According to another example the zero reset mechanism comprises a second wheel coaxial to the first wheel. The second wheel is rotationally locked to the first wheel and is engageable with a pivotable locking lever. The pivotable locking lever may be pivotally arranged on the base or on the tourbillion block. The pivotable locking lever serves to selectively lock the rotation of the second wheel and the first wheel relative to the tourbillion block. When the locking lever is in engagement with the second wheel rotation of at least the second wheel and the first wheel is blocked. Pivoting of the locking lever into a release configuration releases the second wheel and enables a rotation thereof relative to the tourbillion block or relative to the base of the movement.

Typically, the pivotable locking lever comprises at least one or numerous teeth configured to engage with teeth on the circumference of the second wheel. In this way, a rather precise and reliable rotational interlock can be provided for the second wheel and hence for the entire zero reset mechanism.

According to another example the carriage comprises a stop configured to engage with a pivotable stop lever. The pivotable stop lever is pivotable between a stop position and a release position. The stop lever typically comprises a counterstop, e.g. at a free end of the pivotable stop lever. The counterstop is displaceable in radial direction so as to selectively engage with the stop of the carriage. Typically, the stop of the carriage protrudes radially outwardly from the carriage. When the stop lever and in particular its counterstop is in the stop position or stop configuration it is pivoted radially inwardly compared to the release position or release configuration.

Then, the counterstop of the stop lever and the stop of the carriage radially and axially overlap so that a rotation of the carriage is stopped as the stop of the carriage engages with the counterstop of the pivotable stop lever when the stop lever is in the stop position or stop configuration. When arranged in the release position or release configuration the counterstop of the stop lever is displaced radially outwardly. Then, the stop of the carriage may pass by the counterstop of the stop lever and supports an unrestricted rotational movement of the carriage and the tourbillion unit.

According to a further example at least one of a first wheel and the second wheel of the zero reset mechanism is rotationally locked to the carriage when in the reset mode. This rotational interlock can be obtained by a fastening of the balance wheel through the axially displaced brake element. Moreover, activation of the brake element and hence displacing the brake element into the braking position or braking state may be accompanied by a mechanical torque transmitting engagement of the zero reset mechanism, in particular of at least one of the first wheel and the second wheel with the carriage of the tourbillion unit. In this way and upon activating the brake element it is guaranteed that the tourbillion unit is rotationally locked to the zero reset mechanism. In this way and after activating the brake element and after stopping of the balance wheel the tourbillion unit is still hindered to rotate as long as the pivotable locking lever remains engaged with the first wheel.

A rotation and a zero reset motion of the tourbillion unit and of the zero reset mechanism rotationally locked to the carriage of the tourbillion unit is triggered as the pivotable locking lever engaged with the second wheel is pivoted into the release configuration thus enabling a rotation of the first wheel relative to the tourbillion block or relative to the base of the movement. In this way, an uncontrolled dissipation of mechanical energy can be prevented.

According to another example a seconds shaft permanently engaged with a mechanical energy storage is rotationally locked to the carriage. By means of the seconds shaft mechanical energy can be transferred from the mechanical energy storage to the tourbillion unit. When the movement is in the reset mode and when the locking lever is in the release state the carriage and hence the entire tourbillion unit as well as the zero reset mechanism rotationally locked to the carriage is or are rotatable by means of the mechanical energy storage until the stop of the carriage engages with the stop lever.

According to another example the stop lever and the locking lever are mechanically coupled. The mechanical coupling between the pivotable locking lever and the pivotable stop lever provides and enables a pivoting of the locking lever from the locking position into a release position only when the pivotable stop lever is in the stop position or stop configuration. Moreover, a pivoting motion of the locking lever from the release position into the locking position is provided only when the stop lever is in the stop position. In other words, a pivoting motion of the locking lever between the release position and the locking position is only possible and allowed when the stop lever is activated, hence when the stop lever is in the stop position or stop configuration in which the stop lever serves to lock or to stop a rotation of the carriage beyond a predefined position or rotational state.

According to a further example and when the pivotable locking lever is in a release position and when the pivotable stop lever is in a stop position the zero reset mechanism and the carriage are collectively rotatable relative to the tourbillion block and/or relative to the base of the movement until the stop engages with the stop lever, in particular when the radially outwardly protruding stop of the carriage tangentially abuts with a radially inwardly extending counterstop of the stop lever. In this particular stop configuration the carriage and hence a seconds hand fastened to the carriage points to a predefined section of a dial, e.g. to a zero position of the dial.

Typically, the collective or combined rotational motion of the zero reset mechanism and of the carriage or tourbillion unit is induced by the mechanical energy storage via the seconds shaft rotationally locked to the carriage. In this way and as the rotational movement of the zero reset mechanism is released the zero reset mechanism and the tourbillion unit automatically rotate into the predefined rotational state under the effect of the mechanical energy storage. When the locking lever is in the release configuration the tourbillion unit and the zero reset mechanism are substantially void of a mechanical engagement with any other friction-inducing components. In effect, mechanical friction of a combined rotational movement of the tourbillion unit and the zero reset mechanism is comparatively low. Correspondingly, the amount of mechanical energy to rotate the carriage, the tourbillion unit and the zero reset mechanism into the predefined reset position is reduced to a minimum and is hence beneficial for the power reserve of the movement.

According to another example and when the pivotable locking lever is in a release position and wherein when the pivotable stop lever is in a stop position the zero reset mechanism is freely rotatable relative to the tourbillion block. Rotation of the zero reset mechanism and the collective rotation of the tourbillion unit or carriage thereof is rather smooth and is accompanied only with a rather low degree of friction.

According to a further example the zero reset mechanism comprises an adjusting ring coaxial with the first wheel and rotatable relative to the second wheel between a reset position and a release position against the action of at least one reset spring. A rotation of the adjusting ring relative to the second wheel serves to switch the movement between the driving mode and the reset mode. Typically, rotating the adjusting ring against the action of the at least one reset spring brings the movement from the reset mode into the driving mode. Hence, for activating of the reset mode a rotation of the adjusting ring under the action of a relaxing reset spring only has to be released.

When the at least one reset spring is arranged on at least one of the first wheel, the second wheel and the adjusting ring and hence when the at least one reset spring is located and arranged on or in the zero reset mechanism the zero reset mechanism is inherently biased to switch into the reset mode when there is no mechanical interference with any further components of the movement. This particularly enables a free rotation of the zero reset mechanism and of the tourbillion unit when the movement is in the reset mode and when rotation of the first wheel is released by the locking lever pivoted into the release position.

In a further example the at least one reset spring is in engagement with at least one stop latch. The at least one stop latch is pivotably arranged on the zero reset mechanism. The at least one stop latch is pivotable with regard to a pivot axis extending parallel to a rotation axis of the zero reset mechanism. The stop latch is typically pivotable between a stop position and a release position relative to at least one of the first wheel, the second wheel and the adjusting ring.

With a typically example or embodiment the at least one stop latch is arranged on a side of the second wheel. It is pivotable radially inwardly with regard to the rotation or central axis of the second wheel towards the stop position. It is pivotable radially outwardly towards the release position. Typically, the at least one reset spring is directly engaged with the at least one stop latch to urge the stop latch into the radially inwardly located stop position. In this way, a rather automated and spring-driven switching of the movement from the driving mode into the reset mechanism can be provided.

According to a further example the at least one stop latch comprises a beveled section configured to engage with a correspondingly-shaped beveled section of a brake ring. The brake ring is axially displaceable relative to the zero reset mechanism and is operably engaged with the brake element. By inducing an axial displacement of the brake ring relative to the zero reset mechanism the brake element is either axially displaced or axially deformed to reach the braking position or to conform the braking state. By means of a pivoting motion of the at least one stop latch its beveled section is radially displaceable relative to the beveled section of the brake ring. This radial displacement and the pitch or slope of the mutually corresponding beveled section leads to an axial displacement of the brake ring thus inducing the braking effect of the brake element.

In a further example the adjusting ring comprises at least one axially extending cam with a beveled side section. The beveled side section is in radial or tangential abutment with the at least one stop latch. The beveled side section of the cam is further configured to induce a pivoting of the at least one stop latch when the adjusting ring is subject to a rotation relative to the second wheel. Typically, the at least one stop latch is arranged on the second wheel. As the adjusting ring is subject to a rotation of the adjusting ring coaxial to the second wheel the cam of the adjusting ring is subject to a tangentially or circumferentially directed displacement relative to the second wheel and hence relative to the adjusting ring.

Then and in effect the beveled side section of the axially extending cam serves to induce a pivoting of the at least one stop latch. Typically, the rotation of the adjusting ring relative to the second wheel in a direction such that the beveled side section of the cam induces a pivoting of the at least one stop latch acts against the biasing force of the at least one reset spring in engagement with the at least one stop latch. Typically, the at least one reset spring is configured to pivot the at least one stop latch into the stop position in which the brake ring is in a braking position in which the brake element axially engages with the balance wheel.

This reset spring-driven pivoting of the at least one stop latch leads to a respective rotation of the adjusting ring relative to the second wheel via the beveled side section of the cam. In this way the adjusting ring is rotatable relative to the second wheel along a first direction to switch the movement from the reset mode into the driving mode. The rotation along the first direction acts against the restoring force of the reset spring. Moreover, the adjusting ring is rotatable in a second direction counter to the first direction under the effect of the reset spring. In this way, the reset spring serves to induce a rotation of the adjusting ring in the second direction to switch the movement from the driving mode into the reset mode.

In a further example the rotation of the adjusting ring along the second direction may be lockable by means of at least one switching latch pivotably arranged on the tourbillion block or on the base of the movement. The outer circumference of the adjusting ring may comprise a toothing engaged with a counter toothing of the switching latch. As long as the movement is in a driving mode the adjusting ring is locked in a driving position. As the switching latch is activated and releases a rotation of the adjusting ring along the second direction, the adjusting ring is free to rotate from the driving position into the reset position. Hence, as soon as the switching latch releases and liberates the rotating movement of the adjusting ring the at least one reset spring serves to induce a respective rotation of the adjusting ring along the second sense of rotation According to a further example the switching latch may be further configured to engage with the toothing on the outer circumference of the adjusting ring to induce a rotation of the adjusting ring relative to the second wheel along the first sense of rotation and hence to return the adjusting ring from the reset position into the driving position against a spring force provided by the at least one reset spring.

According to another example the at least one stop latch comprises a rotatable wheel in abutment with the beveled side section of the cam. The rotatable wheel may be provided on a free end of the stop latch. The rotatable wheel may be provided on an end of the at least one stop latch located opposite to another end of the at least one stop latch provided with the beveled section. By means of the rotatable wheel, mechanical friction between the beveled side section of the cam of the adjusting ring and the at least one stop latch can be reduced thus providing a smooth pivoting of the at least one stop latch as the adjusting ring is rotated relative to the second wheel.

In a further example the cam protrudes axially through a through opening of the second wheel. The at least one stop latch is arranged on a side of the second wheel that faces away from the adjusting ring. Typically, the at least one stop latch, e.g. its rotatable wheel extends at least partially across or reaches laterally into the through opening of the second wheel. In this way, the beveled side section of the cam protruding through the through opening of the second wheel is brought in mechanical engagement or abutment with the rotatable wheel of the at least one stop latch.

Typically, the through opening of the second wheel may comprise a slotted link or slotted guide for the cam of the adjusting ring. In this way, the cam of the adjusting ring may be guided in circumferential or tangential direction as the adjusting ring rotates relative to the second wheel.

According to a further aspect a clock is provided that comprises a movement as described above. The clock may comprise a flying tourbillion. The clock may be implemented as a wristwatch.

BRIEF DESCRIPTION OF THE DRAWINGS

In the following an example of the movement is described in greater detail by making reference to the drawings in which.

DETAILED DESCRIPTION

Figure 1:
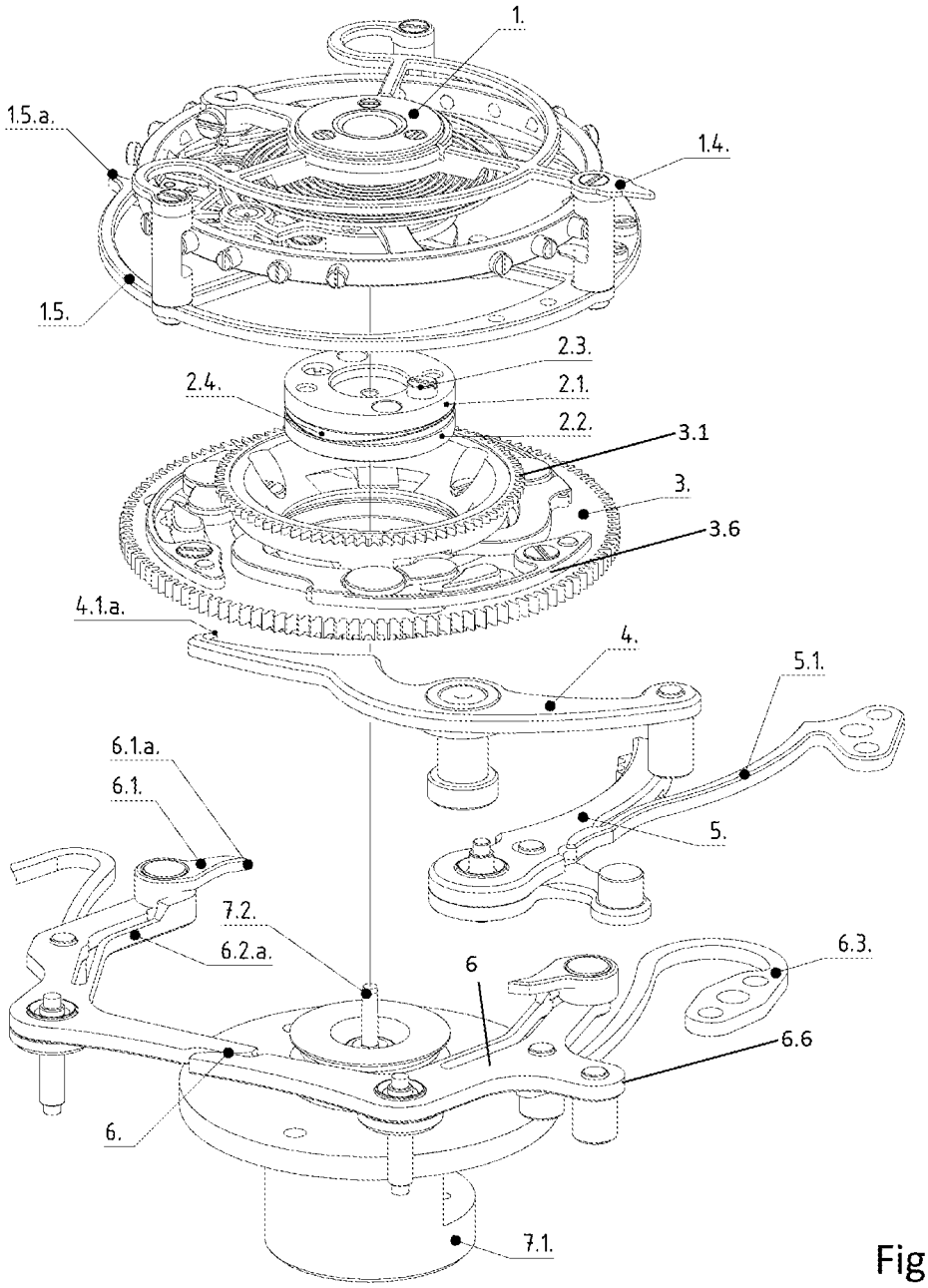
FIG. 1 shows an exploded view of numerous components of the tourbillion unit and the zero reset mechanism (3)
Figure 2:
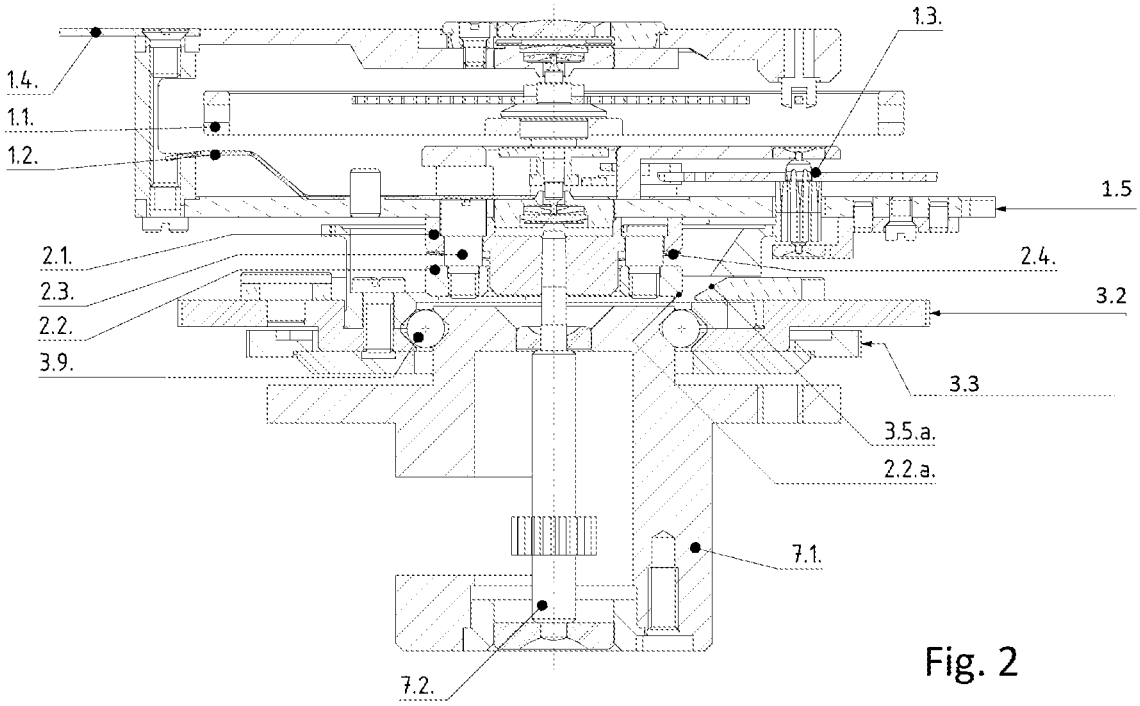
FIG. 2 is a cross-section through the arrangement of FIG. 1.
Figure 10:
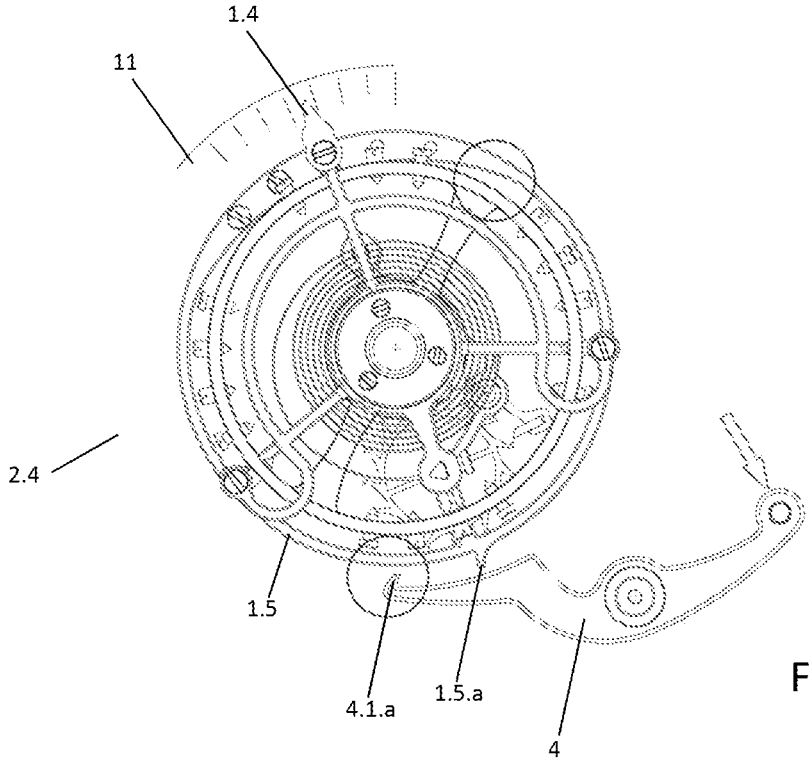
FIG. 10 shows the mutual engagement of the stop of the carriage with the pivotable stop lever when the stop lever is in the stop position.
Figure 14:
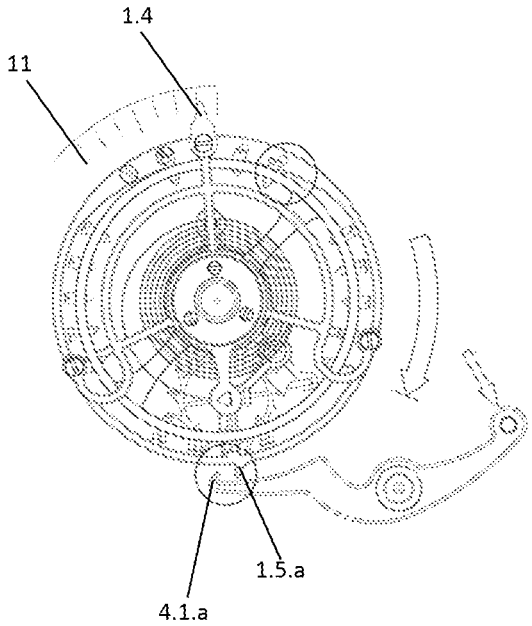

In FIGS. 1 and 2 a movement 10 is illustrated. The movement 10 comprises a tourbillion block 7.1, a tourbillion unit 1 and a zero reset mechanism 3. The tourbillion unit 1 comprises a balance wheel 1.1 rotationally mounted on a carriage 1.5. The balance wheel 1.1 is in engagement with an escape wheel 1.3. The escape wheel 1.3 is further in engagement with a first wheel 3.1 of the zero reset mechanism 3. The carriage 1.5 is further provided with a seconds hand 1.4 configured to illustrate the seconds on a dial 11 as indicated in FIGS. 10 and 14. On the carriage 1.5 there is further provided a radially outwardly protruding stop 1.5.*a*. The stop provides a tangential or circumferential abutment with a correspondingly-shaped counterstop 4.1.*a* of a pivotable stop lever 4.

There is further provided a clutch 2 having a flange 2.1. The flange 2.1 is fastened to a seconds shaft 7.2. The flange 2.1 is rotationally coupled or rotationally fixed to the carriage 1.5. Coaxial with the flange 2.1 there is provided a brake ring 2.2. The brake ring 2.2 is axially displaceable against the action of a disc spring 2.4. The disc spring 2.4 is located axially between the flange 2.1 and the brake ring 2.2. The disc spring 2.4 is configured to axially displace the brake ring 2.2 away from the flange 2.1. There is further provided a transfer element 2.3. The transfer element 2.3 is axially guided in or by the flange 2.1. The transfer element 2.3 is axially displaceable relative to the flange 2.1 by means of the brake ring 2.2. The transfer element 2.3 is in axial abutment with the brake ring 2.2.

Figure 4:
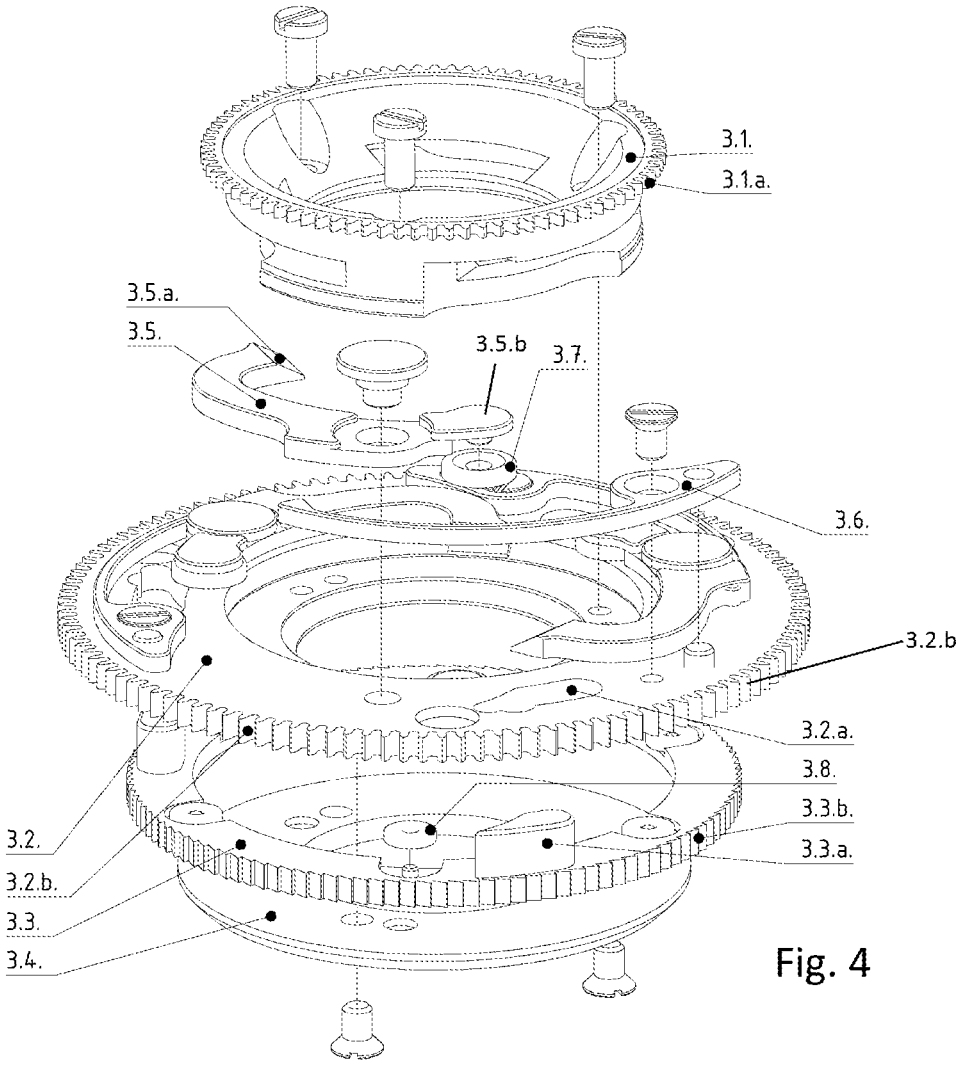
FIG. 4 is an enlarged exploded view of the zero reset mechanism.
Figure 5:
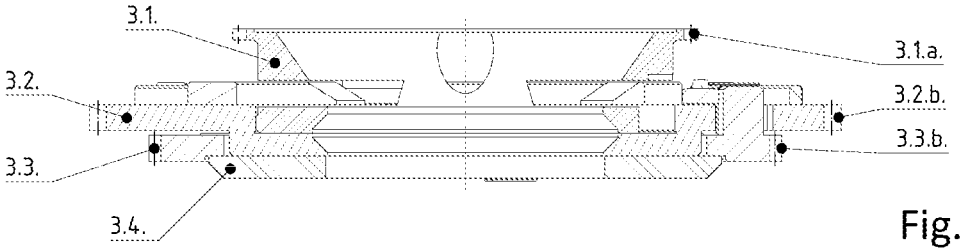
FIG. 5 is a cross-section through the zero reset mechanism.
Figure 9:
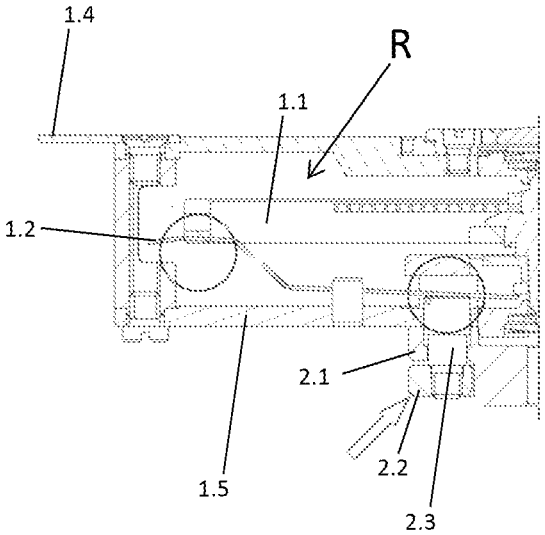
FIG. 9 shows the brake element in the braking state.

When the brake ring 2.2 is displaced axially towards the flange 2.1 the respective movement of the brake ring 2.2 is transferred to the transfer element 2.3. Accordingly, an end section of the transfer element 2.3 facing away from the brake ring 2.2 is configured to protrude axially from a surface of the brake ring 2.2. In this way, the transfer element 2.3 is configured to urge against a brake element 1.2 thus leading to an axial displacement or axial deformation of the brake element 1.2 as it is apparent from a comparison of FIGS. 7 and 9. In this way, the brake element 1.2 which is arranged on the carriage 1.5 is axially displaceable or deformable from a released position as illustrated in FIG. 4 or a released state into a braking position or braking state as illustrated in FIG. 9 in which the brake element 1.2 axially engages with an outer rim of the balance wheel 1.1. In this way, the brake element 1.2 is configured to apply a braking torque to the balance wheel 1.1 and to stop or to hinder the balance wheel 1.1 from rotating or oscillating.

For inducing an axial displacement the brake ring 2.2 comprises a beveled section 2.2.*a* along an outer circumference and facing towards a second wheel 3.2 of the zero reset mechanism 3. The zero reset mechanism 3 comprises a first wheel 3.1 with an outer toothing 3.1.*a*. The outer toothing 3.1.*a* is in engagement with the escape wheel 1.3. On a side of the second wheel 3.2 there are provided numerous stop latches 3.5 that are pivotably displaceable on the second wheel 3.2. In the example as illustrated there are provided three equidistantly arranged stop latches 3.5 that are each pivotable with regard to an axis of rotation extending parallel to a center axis of the zero reset mechanism 3 and hence to a center axis or rotation axis of the first wheel 3.1 and/or of the second wheel 3.2.

Each one of the stop latches 3.5 comprises a first end and a second end located opposite to the first end. The stop latches 3.5 are pivotably arranged on the second wheel 3.2 at a position located between the first end and the second end. The first end is provided with a beveled section 3.5.*a*.

The second end is provided with a wheel 3.7. A radially inwardly directed pivoting motion of the first end is hence accompanied by a radially outwardly directed pivoting motion of the second end; and vice versa.

The beveled sections 3.5.*a* are configured to engage with the beveled section 2.2.*a* of the brake ring 2.2. Hence, a coordinated or simultaneous radially inwardly directed motion of the beveled section 3.5.*a* leads to a respective engagement with the beveled section 2.2.*a* of the brake ring 2.2. As a consequence the stop latches 3.5 slip under a lower face of the brake ring 2.2 thus leading to an axial displacement of the brake ring 2.2 away from the second wheel 3.2. In this way, the transfer element 2.3 is displaced in axial direction thus applying a braking effect onto the balance wheel 1.1 as described above.

Figure 3:
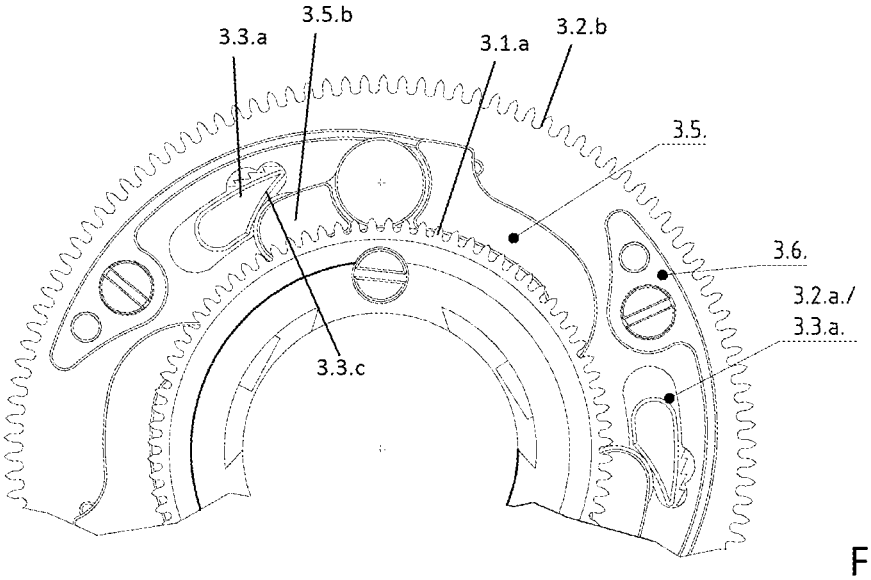
FIG. 3 shows the mechanical interaction of the cams of the adjusting ring with the stop latches.

Each one of the stop latches 3.5 is biased by a stop spring 3.6. As illustrated in FIGS. 3 and 4 the brake springs 3.6 are configured to pivot the first end of the stop latches 3.5 radially inwardly. In this way, a kind of self-driven or automated braking effect is implemented. Under the effect of the stop springs 3.6 the beveled sections 3.5.*a* of the stop latches 3.5 are displaced radially inwardly so as to lift the brake ring 2.2.

The zero reset mechanism 3 further comprises an adjusting ring 3.3 coaxial to the second wheel 3.2 and located on a side of the second wheel 3.2 opposite to the first wheel 3.1. The adjusting ring 3.3 is rotatable or pivotable with regard to its center axis relative to the second wheel 3.2. The adjusting ring 3.3 is sandwiched between the second wheel 3.2 and a bearing ring 3.4. The bearing ring 3.4 and the second wheel 3.2 are mutually fixed. The adjusting ring 3.3 is rotatable or pivotable relative to both, the second wheel 3.2 and the bearing ring 3.4.

On the side of the adjusting ring 3.3 facing towards the second wheel 3.2 there are provided numerous axially extending cams 3.3.*a*. Each one of the cams 3.3.*a* comprises a beveled side section 3.3.*c*. The beveled side section 3.3.*c* is in abutment with the second end 3.5.*b* of a stop latch 3.5. In particular, the beveled side section 3.3.*c* is in radial or tangential abutment with the wheel 3.7 rotationally mounted on the second end 3.5.*b* of the stop latch.

As illustrated further in FIGS. 3 and 4 the cams 3.3.*a* extend through a through opening 3.2.*a* of the second wheel. The axial extension of the cams 3.3.*a* is larger than the thickness of the second wheel 3.2. In this way, at least a portion of the cams 3.3.*a* protrudes from that side of the second wheel 3.2 facing away from the adjusting ring 3.3. In this way, the beveled side section 3.3.*c* of the cams 3.3.*a* is in abutment with the wheel 3.7 of the stop latch 3.5.

The adjusting ring 3.3 is provided with locking teeth 3.3.*b* on an outer circumference thereof. By means of the locking teeth 3.3.*b* a rotation of the adjusting ring 3.3 relative to the second wheel 3.2 can be blocked or initiated in order to release and to enable a rotating motion of the adjusting ring 3.3 relative to the second wheel 3.2.

As illustrated further in FIG. 4 there are provided numerous wheels 3.8 on an inside portion of an outer rim of the adjusting ring 3.3. In this way a well-defined rotational motion of the adjusting ring 3.3 relative to the second wheel 3.2 is supported.

As illustrated further in FIG. 2 there is provided a ball bearing 3.9 between the tourbillion block 7.1 and the zero reset mechanism 3. In particular, the ball bearing or ball bearings 3.9 are arranged between a circumferentially extending groove on the outside of the tourbillion block 7.1 and an inside of the zero reset mechanism 3. An inside facing groove of the zero reset mechanism 3 configured to receive the ball bearings 3.9 is formed by the arrangement of the first wheel 3.1 and the second wheel 3.2.

In this way, the entire zero reset mechanism 3 is free to rotate relative to the tourbillion block 7.1 or relative to a base of the movement 10 (not illustrated).

The movement 10 further comprises a locking lever 5 provided with a spring 5.1. The locking lever 5 comprises a free end 5.2 provided with a toothing 5.2.*a* configured to engage with an outer toothing 3.2.*b* of the second wheel 3.2. If the toothing 5.2.*a* is engaged with the toothing 3.2.*b* a rotation of the second wheel 3.2 and hence a rotation of the entire zero reset mechanism 3 is prevented and blocked.

Figure 12:
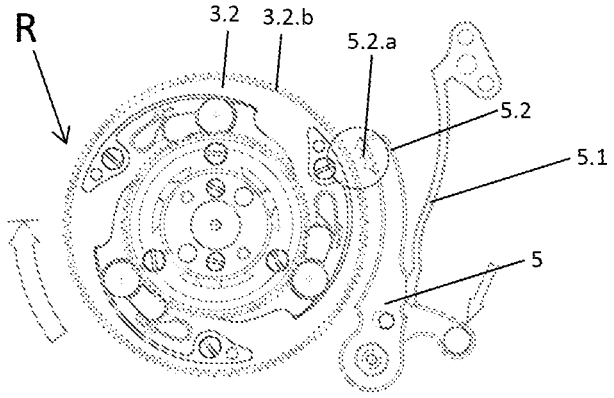
FIG. 12 shows the configuration of FIG. 11 when the locking lever is in the released position.
Figure 13:
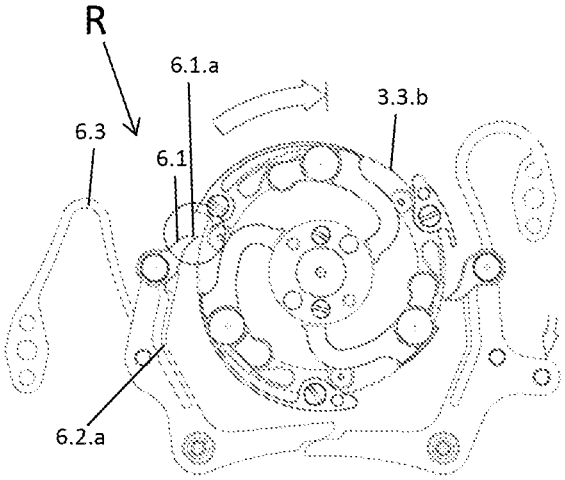
FIG. 13 shows a release of the adjusting ring and FIG. 14 shows a configuration of FIG. 10 shortly before the stop of the carriage engages with a counterstop of the stop lever.

Pivoting of the locking lever 5 against the action of the spring 5.1 releases the zero reset mechanism 2 as illustrated in FIG. 12 thus enabling a rotation of the entire zero reset mechanism 3 relative to the tourbillion block 7.1 and/or relative to the base of the movement 10.

The movement 10 further comprises a stop lever 4 having a counterstop 4.1.*a* at a free end as illustrated in FIGS. 4 and 14. The counterstop 4.1.*a* is configured to abut and to engage with the stop 1.5.*a* of the carriage 1.5. In this way, a rotation of the carriage 1.5 during a zero reset operation can be blocked and impeded as the seconds hand 1.4 reaches a predefined rotational position relative to the tourbillion block 7.1, e.g. a zero second position.

Figure 8:
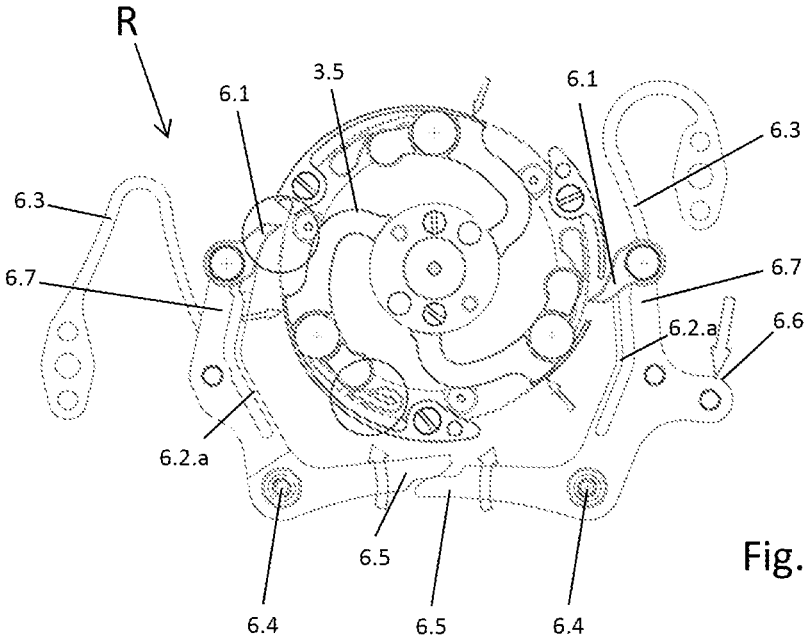
FIG. 8 shows the adjusting ring in engagement with the switching latches when the movement is switched into the reset mode.

The movement 10 further comprises two switching latches 6 as illustrated in FIGS. 1, 6, 8 and 13. The switching latches 6 are each provided with a spring 6.3. The switching latches 6 are pivot mounted on an axis 6.4. Each one of the switching latches 6 comprises a first end by way of which the two switching latches 6 are mutually engaged. Hence, a pivoting motion of one of the switching latches 6 that may be induced by applying a force to a receiving section 6.6 is transferrable via the first end 6.5 to the other switching latch 6. As a force is applied to the receiving section 6.6 the respective switching latch 6 is pivoted in a clockwise direction. Through the mechanical coupling to the other switching latch 6 the other switching latch 6 is pivoted counterclockwise as illustrated in FIG. 8.

Figure 6:
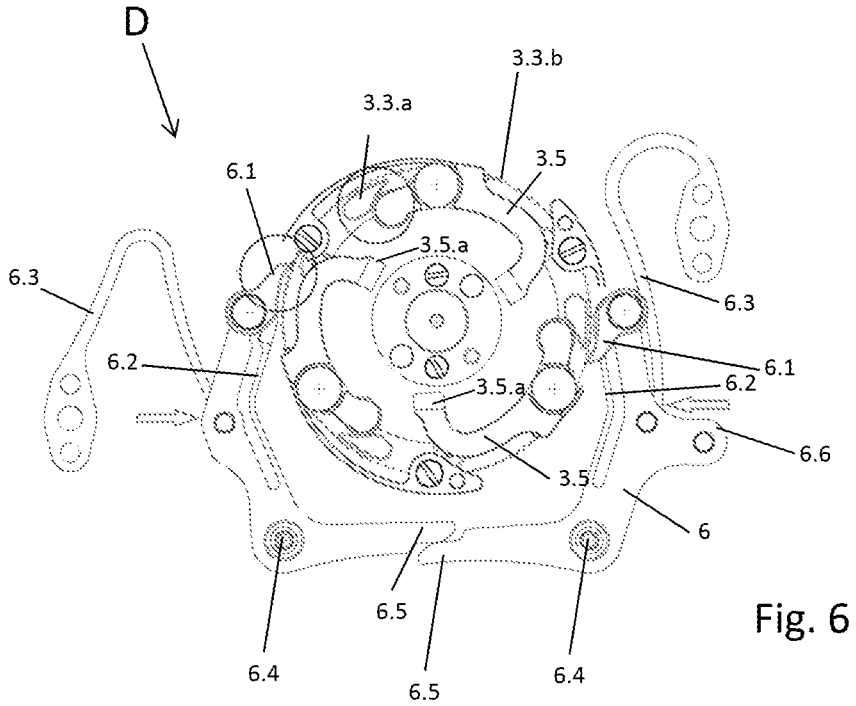
FIG. 6 illustrates the engagement of switching latches with the adjusting ring when the movement is in a driving mode.

The switching latches 6 each comprise a lever 6.7 provided with a further spring element 6.2.*a*. At an end section of the lever 6.7 there is provided a pivoting element having a pointed tip 6.1.*a* in engagement with the locking teeth 3.3.*b* of the adjusting ring 3.3. As illustrated in FIG. 6 the pivoting elements 6.1 are in engagement with the locking teeth 3.3.*b* thus preventing a rotation of the adjusting ring 3.3 relative to the second wheel 3.2. As a force is applied to the receiving section 6.6 the two switching latches 6 are pivoted and the lever sections 6.7 are moved away from the locking teeth 3.3.*b* as illustrated in FIG. 8. As a consequence, the pivoting elements release the locking teeth 3.3.*b* and the adjusting ring 3.3 is released to move or to rotate relative to the second wheel 3.2 under the action of the stop springs 3.6.

The pivoting elements 6.1 are in engagement with the spring elements 6.2.*a*. As the force applied to the receiving section 6.6 is removed, the springs 6.3 tend to displace the lever sections 6.7 radially inwardly thus bringing the pivoting elements 6.1 in engagement with the locking teeth 3.3.*b* thereby inducing a torque onto the adjusting ring 3.3 via the pivoting element 6.1 thus leading to a rotation of the adjusting ring 3.3 against the action of the spring elements 3.6.

Figure 11:
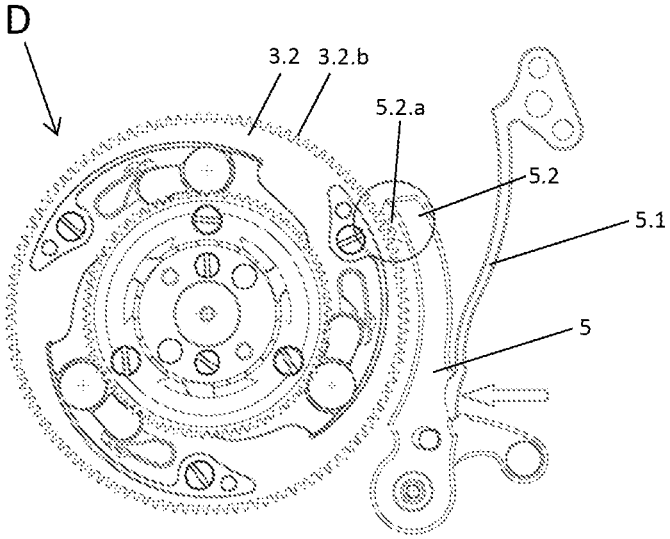
FIG. 11 shows the mutual engagement of the locking lever in engagement with the second wheel.

The operation of the movement 10 for implementing a zero reset function is as follows. In an initial state, also denoted as a driving mode D, the zero reset mechanism 3 is rotationally locked to the tourbillion block 7.1 via the locking lever 5 as illustrated in FIG. 11. The seconds shaft 7.2 is connected to a source of mechanical energy (not illustrated) and provides mechanical energy to the oscillating balance wheel 1.1. The escape wheel 1.3 is in engagement with the outer toothing 3.1.*a* of the first wheel 3.1 of the zero reset mechanism 3. Since the escape wheel 1.3 is rotationally mounted on the carriage 1.5 the entire carriage rotates around the rotationally fixed first wheel 3.1.

In the driving mode D the stop lever 4 is in a release position. The counterstop 4.1.*a* is located radially outside the stop 1.5.*a* of the carriage 1.5. Hence, the stop 1.5.*a* is configured to pass by the counterstop 4.1.*a* as the carriage 1.5 is subject to a rotation.

Moreover, the two switching latches 6 and their pivoting elements 6.1 are in engagement with the adjusting ring 3.3. In this way and while in driving mode D the adjusting ring 3.3 is rotationally fixed relative to the second wheel 3.2. As a user applies a force onto the receiving sections 6.6 of the switching latches 6 the switching latches, in particular the pivoting elements 6.1 are pivoted radially outwardly thus to release the adjusting ring 3.3. Accordingly, the adjusting ring 3.3 is rotated under the effect of the stop springs 3.6 relative to the second wheel 3.2. As described above, the rotation of the adjusting ring 3.3 relative to the second wheel 3.2 allows for a spring-driven pivoting of the stop latches 3.5 because the cams 3.3.*a* that are moved in circumferential direction in the through opening 3.2.*a* enable a respective pivoting of the stop latches 3.5.

Under the action of the reset springs 3.6 each one of the stop latches 3.5 is subject to a radially inwardly directed pivoting motion of its beveled section 3.5.*a*. Accordingly, the brake ring 2.2 is lifted or displaced axially and brings the brake element 1.2 in frictional engagement with an outer rim of the balance wheel 1.1 as illustrated in FIG. 9. The movement and hence the oscillating movement of the balance wheel 1.1 is stopped. The movement is then in a reset mode R.

The seconds hand 1.4 will rest at an arbitrary position relative to the dial of the movement 10. Now and as the balance wheel 1.1 is stopped a user may induce another sequential or combined movement of the stop lever 4 and of the locking lever 5 as illustrated in FIG. 10. The stop lever 4 is pivoted into a stop configuration as shown in FIG. 10 so that the counterstop 4.1.*a* and the stop 1.5.*a* overlap in radial direction. Thereafter the locking lever 5 is pivoted into a release configuration against the action of the spring 5.1 as illustrated in FIG. 12. In this way, the engagement of the toothing 5.2.*a* with the toothing 3.2.*b* is released and abrogated. The entire zero reset mechanism 3 is released and is free to rotate relative to the tourbillion block 7.1.

As the brake ring 2.2 is displaced axially so as to activate the braking of the balance wheel 1.1 the zero reset mechanism 3 becomes rotationally engaged or rotationally locked to the tourbillion unit 1 and hence to the carriage 1.5. In particular, the clutch 2 provides a torque proof engagement between the zero reset mechanism 3 and the tourbillion unit 1 as long as the brake ring 2.2 is in engagement with the stop latches 3.5. In this reset mode R the tourbillion unit 1, in particular the carriage 1.5, which is still in engagement with the seconds shaft 7.2 is rotated under the action of the source of mechanical energy. Due to the rotational coupling between the carriage 1.5 and the zero reset mechanism 3 the entire zero reset mechanism 3 and the carriage 1.5 are subject to a rotation as illustrated in FIG. 14 until the stop 1.5.*a* engages the counterstop 4.1.*a*. The seconds hand 1.4 will then arrive at a zero configuration.

During this combined rotation of the tourbillion unit 1 and the zero reset mechanism a perfect synchronization of the movement with a reference can be provided. While the movement 10 is in the above described reset mode the tourbillion unit 1 as well as the zero reset mechanism 3 are void of any engagement with any latches or other mechanical parts of the movement 10. The total energy required for inducing the combined rotation of the tourbillion unit 1 and the zero reset mechanism 3 can be thus reduced to a minimum. This provides an increase of the power reserve and may further increase the long term stability and precision of the movement 10.

For returning from the reset mode R into the driving mode D the above illustrated steps are executed in a reverse order. Hence, the free end 5.2 of the locking lever 5 engages with the second wheel 3.2 thus to prevent any further rotational movement of the second wheel 3.2 relative to the tourbillion block 7.1. Thereafter, the stop lever 4 is pivoted into the release configuration thus giving way for the stop 1.5.*a* of the carriage 1.5. Thereafter, the switching latches 6 are pivoted under the action of the spring elements 6.3 such that the pivoting elements 6.1 induce a rotation onto the adjusting ring 3.3 against the action of the reset springs 3.6.

Figure 7:
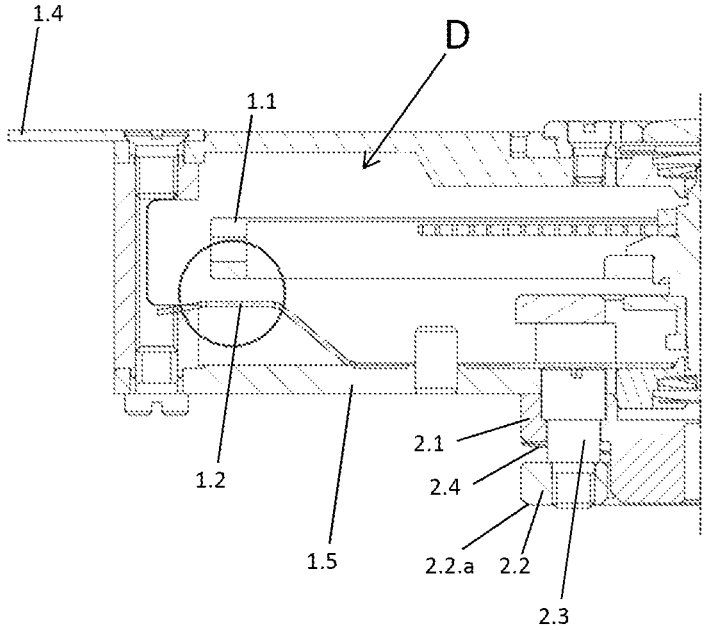
FIG. 7 shows the brake element when in a release state.

The rotation of the adjusting ring 3.3 relative to the second wheel 3.2 leads to a pivoting of the stop latches 3.5 because the beveled side sections 3.3.2 of the cams 3.3.*a* induce a respective pivoting motion onto the stop latches 3.5. Accordingly, the beveled sections 3.5.*a* are pivoted radially outwardly thus enabling and releasing an axially directed displacement of the brake ring 2.2 under the action of the disc spring 2.4. Accordingly, the brake ring 2.2 returns into its release position as illustrated in FIG. 7 and releases the balance wheel 1.1. The movement then starts again to oscillate.

LIST OF REFERENCE NUMERALS

1 tourbillion unit
1.1 balance wheel
1.2 brake element
1.3 escape wheel
1.4 seconds hand
1.5 carriage
1.5.*a* stop
2 clutch
2.1 flange
2.2 brake ring
2.2.*a* beveled section
2.3 transfer element
2.4 disc spring
3 zero reset mechanism
3.1 first wheel
3.1.*a* outer toothing
3.2 second wheel
3.2.*a* through opening
3.2.*b* toothing
3.3 adjusting ring
3.3.*a* cam
3.3.*b* locking teeth
3.3.*c* beveled side section
3.4 bearing ring
3.5 stop latch
3.5.*a* beveled section
3.5.*b* second end
3.6 stop spring
3.7 wheel
3.8 wheel

3.9 ball bearing
4. stop lever
4.1.*a* counterstop
5 locking lever
5.1 spring
5.2 free end
5.2.*a* toothing
6 switching latch
6.1 pivoting element
6.1.*a* pointed tip
6.2.*a* spring element
6.3 spring
6.4 axis
6.5 first end
6.6 receiving section
6.7 lever section
7.1 tourbillion block
7.2 seconds shaft
10 movement
11 dial

The invention claimed is:

1. A movement comprising:

a tourbillion block;

a tourbillion unit; and a zero reset mechanism, the tourbillion unit comprising a carriage, a balance wheel, and an escape wheel, wherein the balance wheel and the escape wheel are rotationally arranged on the carriage and wherein the carriage is rotationally supported on the tourbillion block, wherein the zero reset mechanism comprises a first wheel in engagement with the escape wheel and a second wheel coaxial to the first wheel and rotationally locked to the first wheel, the second wheel including an outer toothing that is configured to engage with a toothing of a pivotable locking lever, wherein the movement is switchable between a driving mode and a reset mode, wherein, when in the driving mode, the zero reset mechanism is rotationally locked to the tourbillion block and wherein, when in the reset mode, the zero reset mechanism is freely rotatable relative to the tourbillion block.

2. The movement according to claim 1, further comprising a brake element arranged on the carriage and being one of axially displaceable and axially deformable from a release position or release state into a braking position or braking state, wherein, when in the braking state, the brake element axially engages with an outer rim of the balance wheel.

3. The movement according to claim 1, wherein the carriage comprises a stop configured to engage with a pivotable stop lever.

4. The movement according to claim 1, wherein, when in the reset mode, the zero reset mechanism or at least one of the first wheel and the second wheel is rotationally locked to the carriage.

5. The movement according to claim 1, wherein a seconds shaft permanently engaged with a mechanical energy storage is rotationally locked to the carriage.

6. The movement according to claim 1, wherein the carriage comprises a stop configured to engage with a pivotable stop lever and wherein, when the pivotable locking lever is in a release position and when the pivotable stop lever is in a stop position, the zero reset mechanism and the carriage are collectively rotatable relative to the tourbillion block until the stop engages with the stop lever.

7. The movement according to claim 1, wherein the carriage comprises a stop configured to engage with a pivotable stop lever and wherein, when the pivotable locking lever is in a release position and when the pivotable stop lever is in a stop position, the zero reset mechanism is freely rotatable relative to the tourbillion block.

8. The movement according to claim 1, wherein the zero reset mechanism comprises an adjusting ring coaxial with the first wheel and rotatable relative to the second wheel between a reset position and a release position against the action of at least one reset spring.

9. The movement according to claim 8, wherein the at least one reset spring is in engagement with at least one stop latch pivotally arranged on the zero reset mechanism, and wherein the at least one stop latch is pivotable with a regard to a pivot axis extending parallel to a rotation axis of the zero reset mechanism.

10. The movement according to claim 9, further comprising a brake element arranged on the carriage and being one of axially displaceable and axially deformable from a release position or release state into a braking position or braking state, wherein, when in the braking state, the brake element axially engages with an outer rim of the balance wheel, and wherein the at least one stop latch comprises a beveled section configured to engage with a correspondingly shaped beveled section of a brake ring being axially displaceable relative to the zero reset mechanism and being operably engaged with the brake element.

11. The movement according to claim 9, wherein the adjusting ring comprises at least one axially extending cam with a beveled side section in radial or tangential abutment with the at least one stop latch and configured to induce a pivoting of the at least one stop latch when the adjusting ring is subject to a rotation relative to the second wheel.

12. The movement according to claim 11, wherein the at least one stop latch comprises a rotatable wheel in abutment with the beveled side section of the cam.

13. The movement according to claim 11, wherein the cam protrudes axially through a through opening of the second wheel and wherein the at least one stop latch is arranged on a side of the second wheel that faces away from the adjusting ring.

14. A clock comprising the movement according to claim 1.

* * * * *